US010434355B1

(12) United States Patent
Kipnis

(10) Patent No.: US 10,434,355 B1
(45) Date of Patent: Oct. 8, 2019

(54) SELF-HOUSED PORTABLE EXERCISE EQUIPMENT

(71) Applicant: Michael Kipnis, Wheeling, IL (US)

(72) Inventor: Michael Kipnis, Wheeling, IL (US)

(73) Assignee: Cyclazoom, LLC, Evanston, IL (US)

( * ) Notice: Subject to any disclaimer, the term of this patent is extended or adjusted under 35 U.S.C. 154(b) by 168 days.

(21) Appl. No.: 15/631,316

(22) Filed: Jun. 23, 2017

Related U.S. Application Data

(60) Provisional application No. 62/353,857, filed on Jun. 23, 2016.

(51) Int. Cl.
*A63B 21/008* (2006.01)
*A63B 21/00* (2006.01)
*A63B 23/035* (2006.01)

(52) U.S. Cl.
CPC .... *A63B 21/0087* (2013.01); *A63B 21/00069* (2013.01); *A63B 21/4034* (2015.10); *A63B 21/4035* (2015.10); *A63B 23/0355* (2013.01); *A63B 21/00047* (2013.01); *A63B 2210/50* (2013.01)

(58) Field of Classification Search
CPC ..... A63B 21/0087; A63B 21/00069; A63B 21/4034; A63B 21/4035; A63B 21/00047; A63B 21/08; A63B 21/0085; A63B 23/0355; A63B 2210/50
See application file for complete search history.

(56) References Cited

U.S. PATENT DOCUMENTS

| | | | | |
|---|---|---|---|---|
| 2,501,270 | A | 3/1950 | Fleming | |
| 2,676,015 | A | 4/1954 | Courtney | |
| 3,092,225 | A | 6/1963 | Kivett | |
| 3,664,666 | A * | 5/1972 | Lloyd | A63B 17/00 482/133 |
| 4,257,593 | A | 3/1981 | Keisel | |
| 4,410,174 | A | 10/1983 | Hamada | |
| 5,230,676 | A | 7/1993 | Terauds | |
| 5,575,742 | A | 11/1996 | Wu | |
| 5,697,870 | A | 12/1997 | Osborn | |
| 5,813,953 | A | 9/1998 | Whipple | |
| 6,093,136 | A | 7/2000 | Whipple | |
| 6,565,485 | B1 | 5/2003 | Kinsella | |
| 6,634,998 | B2 | 10/2003 | Siaperas | |

(Continued)

FOREIGN PATENT DOCUMENTS

GB 2494404 A 3/2013

*Primary Examiner* — Megan Anderson
(74) *Attorney, Agent, or Firm* — Brian Roffe

(57) ABSTRACT

Exercise equipment includes a case having first and second parts. The first part is movable relative to the second part and defines a closed state in which an interior compartment is defined and an open state in which the interior compartment is accessible. The first and second parts each have a bottom panel and at least one side panel extending from an outer edge thereof. The first part includes a pair of connection implements in or on side panels opposite one another. In a use state, a connection pin engages with the connection implements, a pneumatic cylinder connects to the connection pin and includes an extendable actuating rod, and an attachment is attachable to the actuating rod and allows a user to interact therewith to exercise. The connection pin, pneumatic cylinder, and attachment fits in the interior compartment in their storage state.

20 Claims, 12 Drawing Sheets

(56) References Cited

U.S. PATENT DOCUMENTS

| | | | | |
|---|---|---|---|---|
| 8,702,570 | B1 | 4/2014 | DelPriore et al. | |
| 9,364,709 | B2 | 6/2016 | Butler et al. | |
| 10,188,892 | B1 * | 1/2019 | Gvoich ..... | A63B 21/0605 |
| 10,315,064 | B2 * | 6/2019 | Pinkus ..... | A63B 21/0552 |
| 2006/0058166 | A1 | 3/2006 | Normandia | |
| 2007/0066454 | A1 | 3/2007 | Foley | |
| 2013/0231228 | A1 | 9/2013 | Wyatt et al. | |
| 2013/0319808 | A1 | 12/2013 | MacClure et al. | |

* cited by examiner

SELF-HOUSED PORTABLE EXERCISE EQUIPMENT

CROSS-REFERENCE TO RELATED APPLICATION

This application claims priority under 35 U.S.C. § 119 of U.S. provisional patent application Ser. No. 62/353,857 filed Jun. 23, 2016, now expired, which is incorporated by reference herein.

BACKGROUND OF THE INVENTION

1. Field of the Invention

This invention is generally related to portable exercise equipment and methods of use and more particularly to exercise equipment that includes a case for use in transporting the equipment and in performing exercises, and to a method of performing exercises with the case and equipment transported therein.

Health benefits of physical exercise are widely known. While a significant number of people currently use home gyms or health clubs to follow an exercise regimen, when travelling, access to such equipment is not readily available. Although some portable exercise devices have been developed, such devices are similarly associated with bulkiness, lack of durability and inability to sufficiently mimic workouts as performed in the home gym or the health club. What is needed is better, more efficient portable exercise devices.

2. Description of the Prior Art

Prior art of interest to the field of the invention is as follows:

U.S. Pat. No. 4,410,174 (Hamada) describes a pommel handle exercise apparatus comprising a case made of two semicylindrical halves, each of the halves having an outer, convex surface and being hinged at one end to the other half. Each of the case halves is provided with means for removably attaching pommel handles to the outer convex surface thereof, in an upright, rigid manner. For travelling, the pommel handles are removed and placed inside of the hollow spaces of one the case halves and the other case half is then folded over the first case half by means of the hinge and latched in place to, in effect, form a carrying case. A carrying handle attached to one of the end pieces of one of the case halves provides a means for conveniently carrying the collapsed exercise horse.

U.S. Pat. Nos. 5,813,953 and 6,093,136 (Whipple) describe an apparatus for performing exercises including a case for transporting the exercise device and for use in performing the exercises. The case can be a simulated briefcase, so that the exercise device can be carried around like ordinary luggage, or be another type of container. The case includes elastic cables which can be moved from stowed positions in the case to exercising positions in which portions of the cables extend outwardly from the case. The portions of the cables remaining in the case are restrained against stretching thereby allowing essentially only the portions of the cables extending outwardly from the case to be stretched. In performing exercises, the outwardly extending portions of the cables are pulled against the case, thereby setting up isometric forces which resist the pulling action and enable the desired strength training.

U.S. Pat. No. 8,702,507 (DelPriore et al.) describes a portable multi-purpose exercise device comprising a base having an interior space defined therein with a plurality of compartments, foldable legs coupled to a bottom side of the base, rotatable handles coupled to the base, side handles coupled to handle sides of the base, a shaft coupled to a shaft side of the base, a pulley rotatable element mounted on the shaft, and inward bowl-like projections stationed on corners of the base.

SUMMARY OF THE INVENTION

Exercise equipment in accordance with the invention includes a case having at least first and second parts, e.g., case halves. The first part is movable relative to the second part and the case defines a closed state in which an interior compartment is defined therein and an open state in which the interior compartment is accessible. Each of the first and second parts has a bottom panel and at least one side panel extending from an outer edge of the bottom panel. The first part, and also maybe the second part, includes a pair of connection holes in the at least one side panel opposite one another.

A connection pin fits in the interior compartment and, when removed therefrom, is configured to extend through the connection holes with a portion extending beyond both connection holes. A first pneumatic cylinder fits in the interior compartment and, when removed therefrom, is connectable to the connection pin and includes an actuating rod that is extendable from the first pneumatic cylinder. An attachment fits in the interior compartment, and when removed therefrom, is attachable to the actuating rod and allow a user to interact therewith to exercise.

Support legs are configured to fit in the interior compartment, and when removed therefrom, have an extended position in which they support the first and second parts above a support surface. Support legs generally constitute a support structure for enabling the first and second parts to define a bench or a substantially flat surface above ground or floor level.

The support legs may be pivotally connected to each of the first and second parts, and thus foldable outward from the interior compartment to form a support structure for the first and second parts. Joints pivotally connect ends of each of the support legs to the at least one side panel of each of the first and second parts.

The bottom panel may be rectangular and the at least one side panel may comprise four side panels. The connection holes may be formed in opposite side panels. The first part may include an additional pair of connection holes in opposite side panels.

A handle is attached to an exterior of the first part and at least one wheel is attached to the first or second part at an opposite end of the case from the handle.

A second pneumatic cylinder fits in the interior compartment, and when removed therefrom, is connectable to the connection pin on an opposite side of the first part from a side on which the first pneumatic cylinder is connectable to the connection pin. The second pneumatic cylinder includes an actuating rod that is extendable from the second pneumatic cylinder. In this case, the attachment comprises an elongate bar attachable to the actuating rods of both the first and second pneumatic cylinders.

A first tension control device fits in the interior compartment, and when removed therefrom, is connectable to the first pneumatic cylinder to control resistance of outward movement of the actuating rod from the first pneumatic cylinder. A second tension control device fits in the interior compartment, and when removed therefrom, is connectable to the first pneumatic cylinder to control resistance of inward movement of the actuating rod into the first pneumatic cylinder. The first and second tension devices may be used together or independently of one another.

A belt lock pin fits in the interior compartment, and when removed therefrom, extends through the connection holes with a portion extending beyond both of the connection holes. A fits in the interior compartment, and when removed therefrom, is connected to the belt lock pin.

When the exercise equipment include the first and second pneumatic cylinders, the attachment may be two baskets each attachable to a respective actuating rod of the first and second pneumatic cylinders. Support bars support a respective pneumatic cylinder when extending longitudinally outward from a longitudinal end of the first part.

When the first part includes an additional pair of connection holes in the at least one side panel opposite one another and the second part includes two pair of connection holes in the at least one side panel opposite one another, connection pins engage with a respective connection holes in an exposed side of the case when an opposite side is against a support surface. Two longitudinally extending connection bars fit in the interior compartment, and when removed therefrom, and connectable to exposed end regions of aligning connection pins. A cylinder support bar fits in the interior compartment, and when removed therefrom, is connectable to the connection bars and extends beyond lateral edges of the case. The first and second pneumatic cylinders are attachable to end regions of the cylinder support bar. The attachment includes plates connected to lower ends of the first and second pneumatic cylinders and a basket attachable to each of the plates. The plates and baskets fit in the interior compartment, and when removed therefrom, the plates rest on the support surface. A handle bar fits in the interior compartment, and when removed therefrom, is attachable to one set of the cylinder connection pins.

The attachment may include a table attachable to the first part, and including, on each side, two support bars that are connected to the connection pin at one end region, with an opposite end region of the support bars being connected to the table.

The second part may be configured to be attached to the first part at an angle between 90 and 180 degrees to form an angled bench.

Further objects and advantages of this invention will become apparent from a consideration of the included figures with corresponding description.

DESCRIPTION OF THE DRAWINGS

The invention, together with further advantages thereof, may best be understood by reference to the following description taken in conjunction with the accompanying drawings, wherein like reference numerals identify like elements, and wherein.

DETAILED DESCRIPTION OF THE INVENTION

Figure 1A:
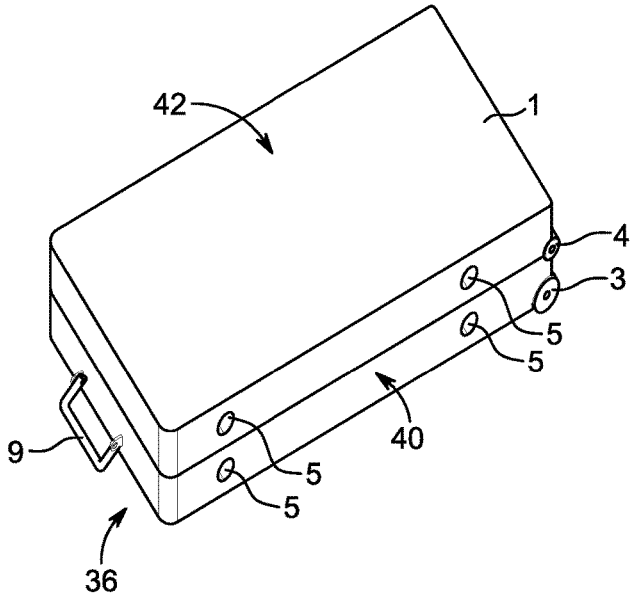
FIG. 1A is a perspective view of an exercise equipment system in accordance with the invention when in a transport state.
Figure 1B:
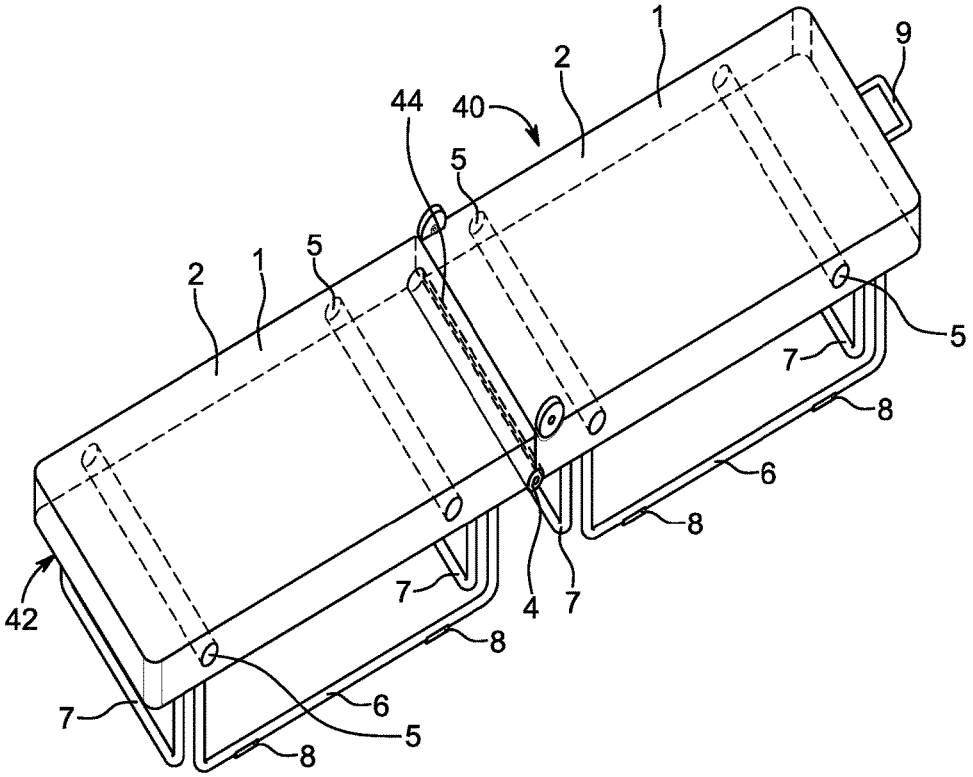
FIG. 1B is a perspective view of the exercise equipment system in accordance with the invention when in a use state.

Referring to the accompanying drawings wherein like reference numbers refer to the same or similar elements, an exercise equipment 36 in accordance with the invention has at least two states, a closed transport state shown in FIG. 1A in which it can be transported and stored, and an open use state shown in FIG. 1B wherein it can be used in the performance of a variety of exercises.

When in the transport and storage state shown in FIG. 1A, the exercise equipment 36 can be moved from one place to another by a person grasping a handle 9 at a top of a case 1, in order to pull the case 1 connected to the handle 9. Handle 9 is attached to a top panel of a case half 40 in a manner known to those skilled in the art of suitcase construction, since the case 1 can have a form and construction similar to a suitcase. Typically, the handle 9 is pivotally mounted to the case half 40. A closure mechanism (not shown), such as one or more latches, is provided on the case halves 40, 42 to allow the case halves 40, 42 to be securely attached together and prevent inadvertent opening of the case 1.

Movement of the case 1 is assisted by one or more removable wheels 3 at a bottom of the case 1. The wheels 3 may be attached to the same case half 40 as the handle 9 as shown, or the wheels 3 and handle 9 attached to opposite case halves 40, 42. The wheels 3, of which there is at least one on each side of the case 1, are attached to panels of the case half 40 in a manner known to those skilled in the art of suitcase construction. Instead of putting the wheels 3 on the sides of the case 1, it is also possible to put the removable wheels at the bottom of the case 1.

Case 1 thus includes the two case halves 40, 42 with the handle 9 and wheels 3 being attached to the lower case half 40. Case halves 40, 42 are preferably made of a rigid material, such as metal or a strong plastic. Each of the case halves 40, 42 has a bottom panel and at least one side panel extending from an outer edge of the bottom panel. As shown, the bottom panel is substantially rectangular so that there are four side panels. However, the bottom panel can have any shape and thus the number of side panels will vary dependent on the shape of the bottom panel.

Each case half 40, 42 defines part of an interior of the case 1 that is capable of retaining components of the exercise equipment 36, discussed below. Case 1 may thus be considered a housing defining an interior compartment. It is possible that case halves 40, 42 are not exactly identical in shape or have equal interior compartments. That is, the height of the case half 40 may be different than that of the case half 42. Thus, the term case "half" is used herein to mean a structure that cooperates with a similar but not necessarily identical part to form a case 1 with an interior compartment. The term "half" does not mean that the interior volume of each case half 40, 42 must be exactly one half the total interior volume of the case 1 when in the closed state.

A hinge system 4 interacts with the case halves 40, 42 to enable them to pivot relative to one another between the closed and open states. Hinge system 4 would typically include an axle 44 (see FIG. 1B) that extends through part of each of the case halves 40, 42 and defines a pivot axis about which the case halves 40, 42 pivot relative to one another between the closed and open states. Ideally case halves 40, 42 and hinge system 4 are configured such that when the case halves 40, 42 are open and a bench 2 is formed therefrom, the broad surfaces of the case halves 40, 42 are in the same or substantially the same plane (see FIG. 1B). This provides a flat surface on which a user can lie down in order to perform exercises from a lying-down position.

FIG. 1A also shows connection holes 5 on one side of each of the case halves 40, 42. The opposite sides of the case halves 40, 42 include similar connection holes 5 as shown in FIG. 1B. The connection holes 5 on each side of the case halves 40, 42 align with one another (see FIG. 1B). Releasable covers for the connection holes 5 may be provided to cover the connection holes 5 when not being used, these covers are not shown. Instead of connection holes 5 that extend through the side panel(s), other types of connection implements may be used to accept the mating structure of the connection holes 5, e.g., hook and loop type fasteners on the connecting parts, tongue and groove type connectors on the connecting parts, with one of the mating structure on the side panels instead of the holes 5 and the other of the mating structure on a connection pin 14.

Exercise equipment 36 is configured to provide the use state forming a bench 2 shown in FIG. 1B by attaching one or more pivotable support legs 6, 7 to each case half 40, 42.

Legs 6 are longitudinal legs that have a lowermost frame section extending in a longitudinal direction of the exercise equipment 36. Each end region of the longitudinally extending frame section is connected to or integral with a vertically extending frame section which is connected at an opposite end region to one of the case halves 40, 42. There are two longitudinal legs 6 for each case half 40, 42, i.e., on opposite sides of the case half 40, 42.

Connection of the upper end of the vertically extending frame section of each longitudinal leg 6 is a pivotal connection to enable the longitudinal leg 6 to pivot downward from a position within the case half 40, 42 to the extended position shown in FIG. 1B. Pivotal mounting structure to enable the outward pivoting of the longitudinal legs 6 from a position stored in the interior compartment defined by the case halves 40, 42 to the position shown in FIG. 1B are commercially available. The mounting structure could include a housing attached to the inner surface of the side panel of the case half 40, 42, and a pivot pin attached to this housing and extending through the upper end region of the vertically extending frame section of the longitudinal leg 6.

Legs 7 are transverse or cross legs that have a lowermost frame section extending in a direction transverse (perpendicular) to the longitudinal direction of the exercise equipment 36. Each end region of the transversely extending frame section is connected to or integral with a vertically extending frame section which is connected at an opposite end region to one of the case halves 40, 42. There are two cross legs 7 for each case half 40, 42, i.e., on opposite sides of the case half 40, 42.

Connection of the upper end of the vertically extending frame section of each cross leg 7 is a pivotal connection to enable the cross leg 7 to pivot downward from a position within the case half 40, 42 to the extended position shown in FIG. 1B. Pivotal mounting structure to enable the outward pivoting of the cross legs 7 from a position stored in the interior compartment defined by the case halves 40, 42 to the position shown in FIG. 1B are commercially available. The mounting structure could include a housing attached to the inner surface of the side panel of the case half 40, 42, and a pivot pin attached to this housing and extending through the upper end region of the vertically extending frame section of the cross leg 7.

Instead of fixing the legs 6, 7 to the case halves 40, 42 it is also possible to provide the legs 6, 7 loose, i.e., completely detached from the case halves 40, 42 when in the stored state. The legs 6, 7 must then be attached to the case halves 40, 42 for use.

Pads 8 are optionally provided on the lowermost frame sections of the longitudinal legs 6 and cross legs 7 to avoid damage to the surface on which the exercise equipment 36 is placed when in the use state (see FIG. 1B).

To obtain the open use state of the case 1 shown in FIG. 1B, the user would grasp each longitudinal leg 6 and each cross leg 7 while situated in the interior volume defined by the case halves 40, 42 and pull them upward and outward. The exercise equipment 36 would typically be inverted to expose the interior compartment of the case haves 40, 42 and then the legs 6, 7 extended (pivoted) upward and outward. A locking mechanism may be provided, e.g., integrated into the pivotal mounting structure, to lock the legs 6, 7 in their extended position. Such locking mechanisms are commercially available and known to those in, for example, the portable table field.

Thus, the case 1 includes a total of 4 longitudinal legs 6 and four transverse legs 7, two of each in each of the case halves 40, 42. It is possible of course to use a different number of legs 6, 7 provided the bench 2 is stable when supported by the legs. Also, it may be possible to form a single combined leg from a longitudinal leg 6 and a transverse leg 7. The legs 6, 7 are preferably made of metal or another rigid material.

Figure 2:
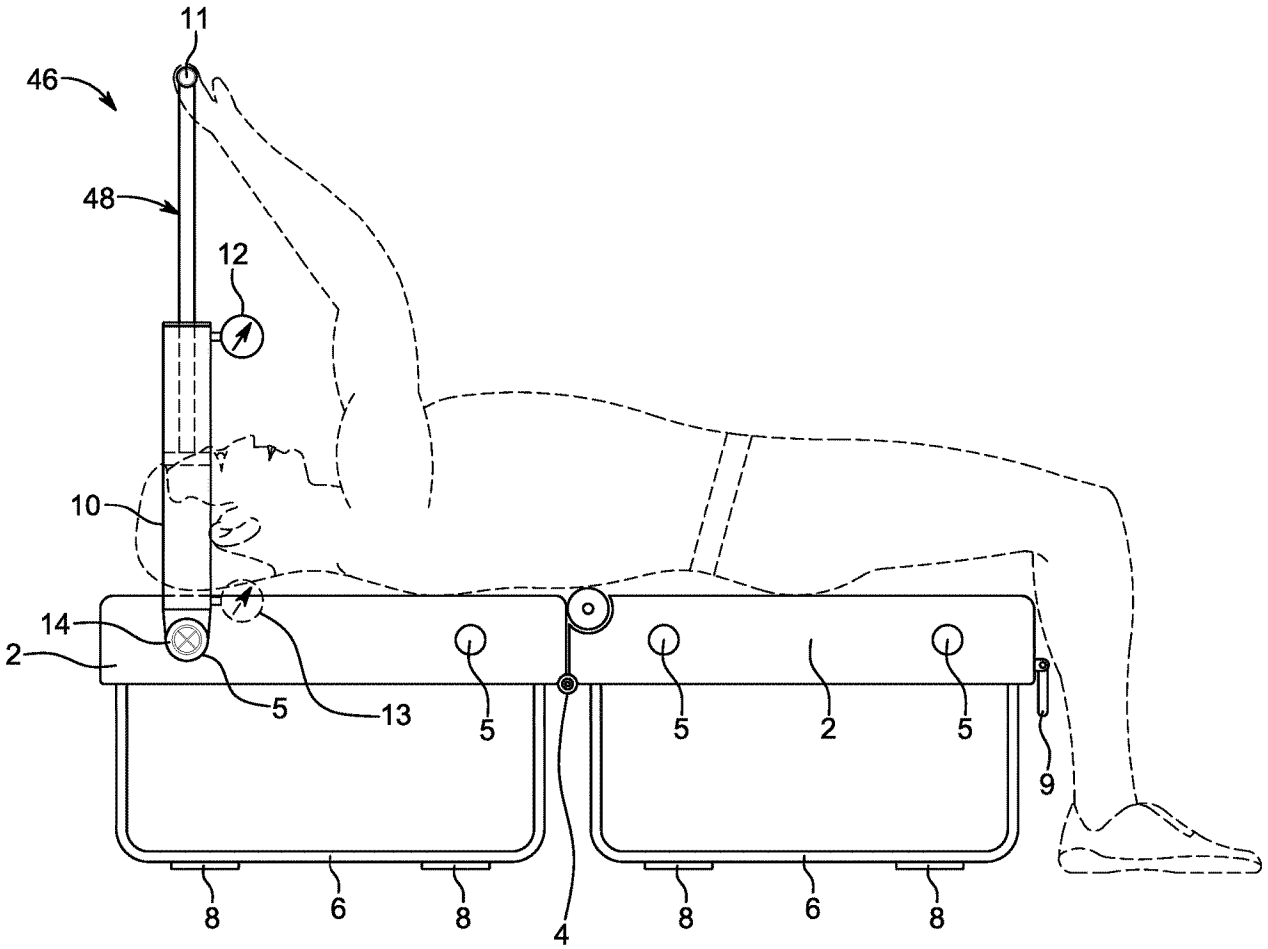
FIG. 2 is a side view of the exercise equipment system in accordance with the invention when in a use state including a hand-actuated exercise bar.

Referring now to FIG. 2, it can be seen that the hinge system 4 is configured to provide the broad surfaces of the case halves 40, 42 to be in the same or substantially the same plane to form the bench 2 with a flat upper exercising surface and allow a user to lie flat on the broad surfaces of the bench 2 formed from the case haves 40, 42. FIG. 2 shows a particular state of the exercise equipment 36 in the use state wherein an arm exercising attachment 46 is coupled to the bench 2.

The arm exercising attachment 46 comprises a connection pin 14 passing through one set of aligning connection holes 5 on case half 40, and two pneumatic cylinders 10 each coupled to a respective end region of the connection pin 14. For example, connection pin 14 may extend through supports that support the pneumatic cylinders 10. The supports of the pneumatic cylinders 10 can be secured to the connection pin 14 by, for example, clamps (not shown), thereby securing the pneumatic cylinders 10 to the connection pin 14 and through the connection pin 14 to the case half 40. Connection pin 14 thus connects an end region of the support of the pneumatic cylinders 10 to the side panels of the case half 40.

Instead of a single connection pin 14, it is possible to use other connection structure, such as two connection pins that can have a structure like a nut and bolt, or similar structure that functions to connect a metal or plastic member to another metal or plastic member in a secure manner to prevent relative movement therebetween.

Figure 4:
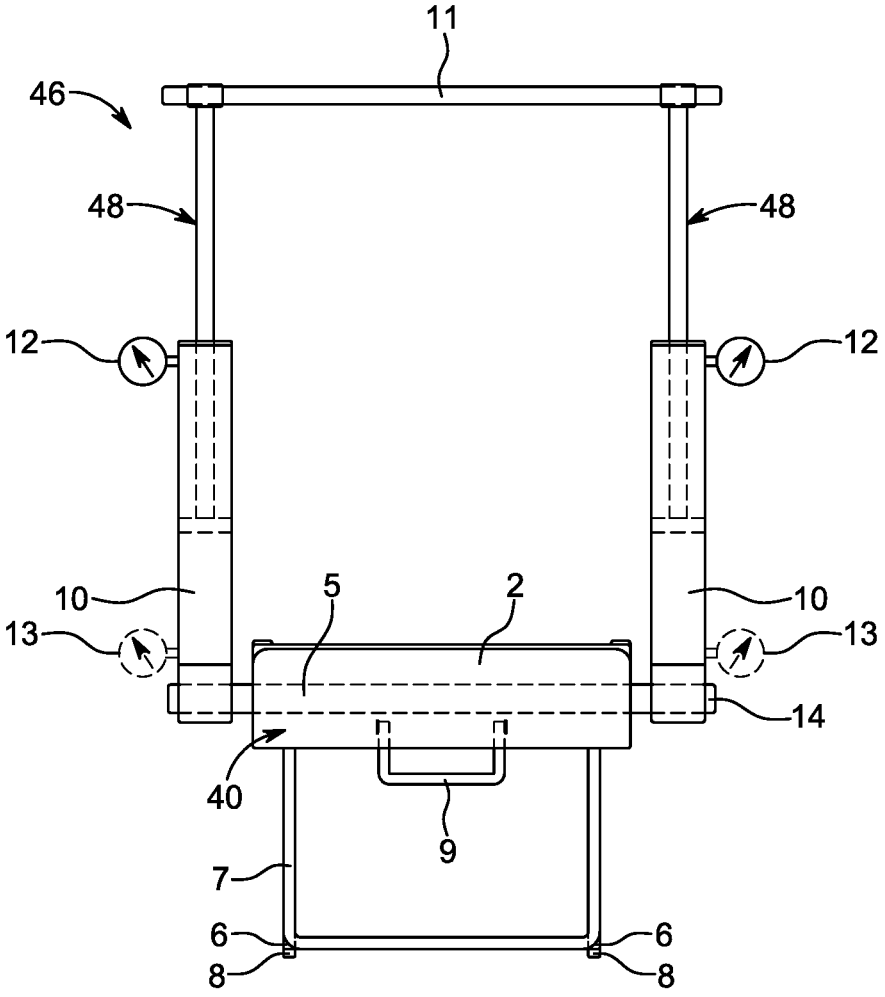
FIG. 4 is a front view of the exercise equipment system in accordance with the invention when in a use state including a hand-actuated exercise bar as shown in FIG. 2.

The arm exercising attachment 46 also comprises an elongate bar 11 connected at its end regions to actuating rods 48 that extend from the pneumatic cylinders 10 and an adjustable force gauge 12 associated with an upper region of each pneumatic cylinder 10 (see FIG. 4). The bar 11 may be made of metal and rigid. The attachment of the bar 11 to the actuating rods 48 may be by inserting the bar 11 through apertures defined at the end regions of the actuating rods 48 and then tightening the bar 11.

The gauge 12 functions to control the resistance of movement of the actuating rods 48 that extend from the pneumatic cylinders 10. By adjusting the gauge 12, it becomes easier or more difficult to extend the actuating rods 48 from the pneumatic cylinders 10 thereby providing an adjustable exercising force.

The components of the arm exercising attachment 46 are housed in the interior compartment defined by the case 1 when in the closed state shown in FIG. 1A.

FIG. 2 also shows an outline of a person exercising using the arm exercising attachment 46. The person lies on the broad surfaces of the case halves 40, 42, with their feet on the ground beyond the rear end of the case 1. The person positions their head at the front end of the case 1, and then grasps the bar 11 with their hands. They can adjust the gauges 12 to control the desired extension tension and then exercise their arms by doing arm extensions.

Figure 3:
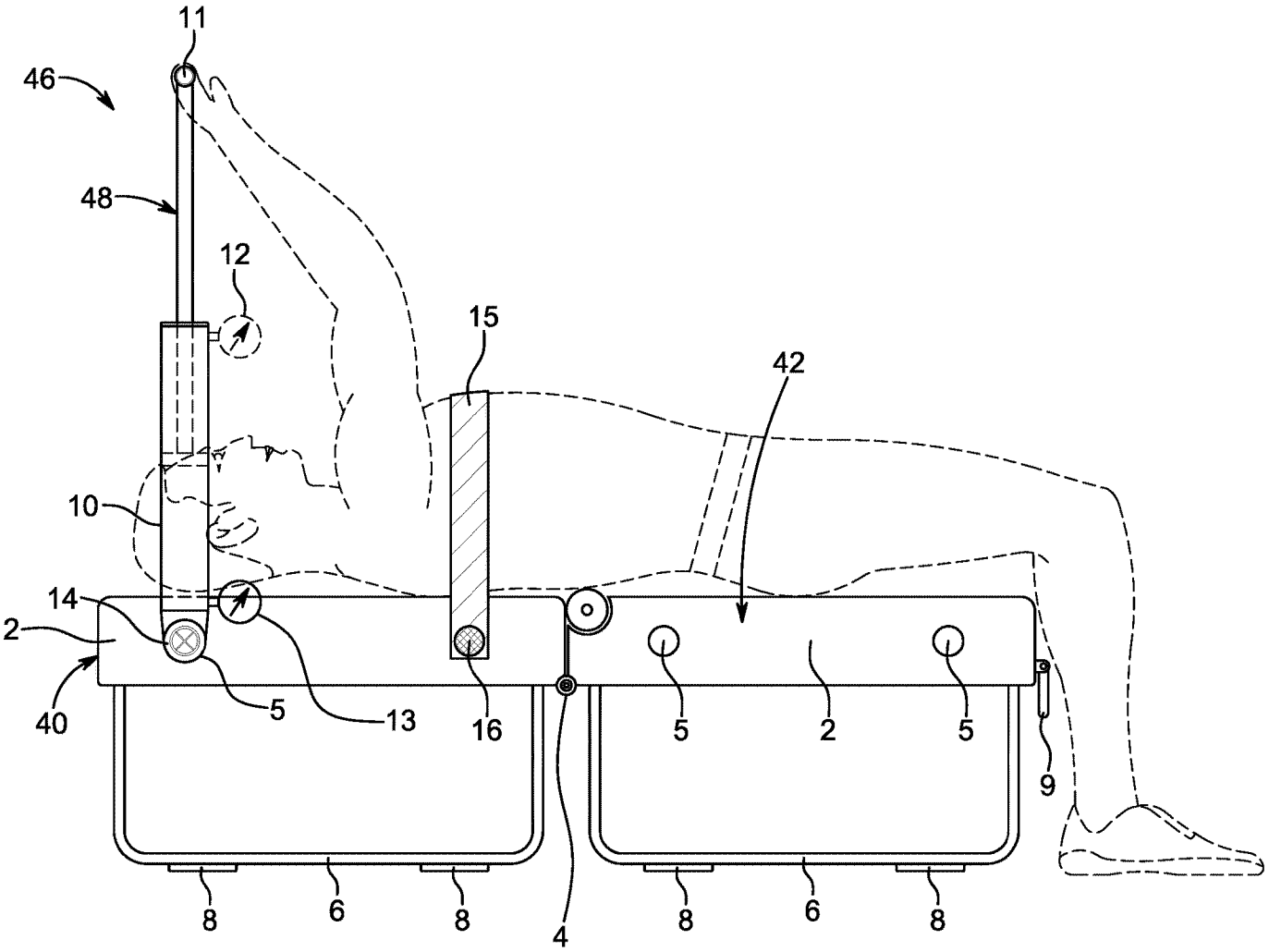
FIG. 3 is a side view of the exercise equipment system in accordance with the invention when in a use state including a hand-actuated exercise bar as shown in FIG. 2 with the addition of a belt.

Optionally, the user can attach a belt 15 to another set of aligning connection holes 5 on the case half 40 via a belt lock pin 16 as shown in FIG. 3. Belt lock pin 16 connects end regions of the belt 15 to the side panels of the case half 40. Belt lock pin 16 may have a construction similar to connection pin 14, e.g., a single pin extending through the aligning connection holes 5 and through holes in the belt 15, or structure like a nut and bolt, or similar structure that functions to connection a metal or plastic member to another metal or plastic member in a secure manner to prevent relative movement therebetween.

Belt 15 aids in keeping the user's chest against the bench 2. Instead of attaching the belt 15 to a set of aligning connection holes 5 on the case half 40, the user could alternatively connect the belt 15 to a set of aligning connection holes 5 on the case half 42, again using belt lock pin 16.

FIGS. 2-4 also show the use of an adjustable force gauge 13 associated with a lower region of each pneumatic cylinder 10. Each gauge 13 functions to control the pressure in the pneumatic cylinder 10 below the respective actuating rod 48 and thus resistance to movement of the actuating rod 48 into the pneumatic cylinder 10. By adjusting the gauges 13, it becomes easier or more difficult to retract the actuating rods 48 into the pneumatic cylinders 10 thereby providing an adjustable exercising force.

Gauges 12 and 13 can be used independently or together. Gauges 12 function to control the force needed to effect the extension stroke of the bar 11 upward away from the bench 2 while gauges 13 function to control the force needed to effect the retraction stroke of the bar 11 downward toward the bench 2.

Gauges 12 and 13 represent any type of tension, pressure or force control device that can be adjusted to enable a varying or adjustable exercise force. Other comparable or equivalent components are known to those skilled in the exercise equipment field, and considered to be part of the invention.

In use, the user passes the connection pin 14 through the aligning holes 5 in case half 40, removing the covers of the holes 5 if present. The user then attaches the pneumatic cylinders 10 to the connection pin 14 and fixes then thereto, e.g., using clamps. The user then attaches the bar 11 to the actuating rods 48 extending from the pneumatic cylinders 10. The arm exercise attachment 46 is then ready for use.

The user lies on the broad surfaces of the case halves 40, 42 defining the bench 2 and places their head below the bar 11. The user adjusts the gauges 12, 13 on both the left and right sides to the desired pressure. The user then can exercise their arms pushing the bar 11 outward and retracting it.

Figure 5:
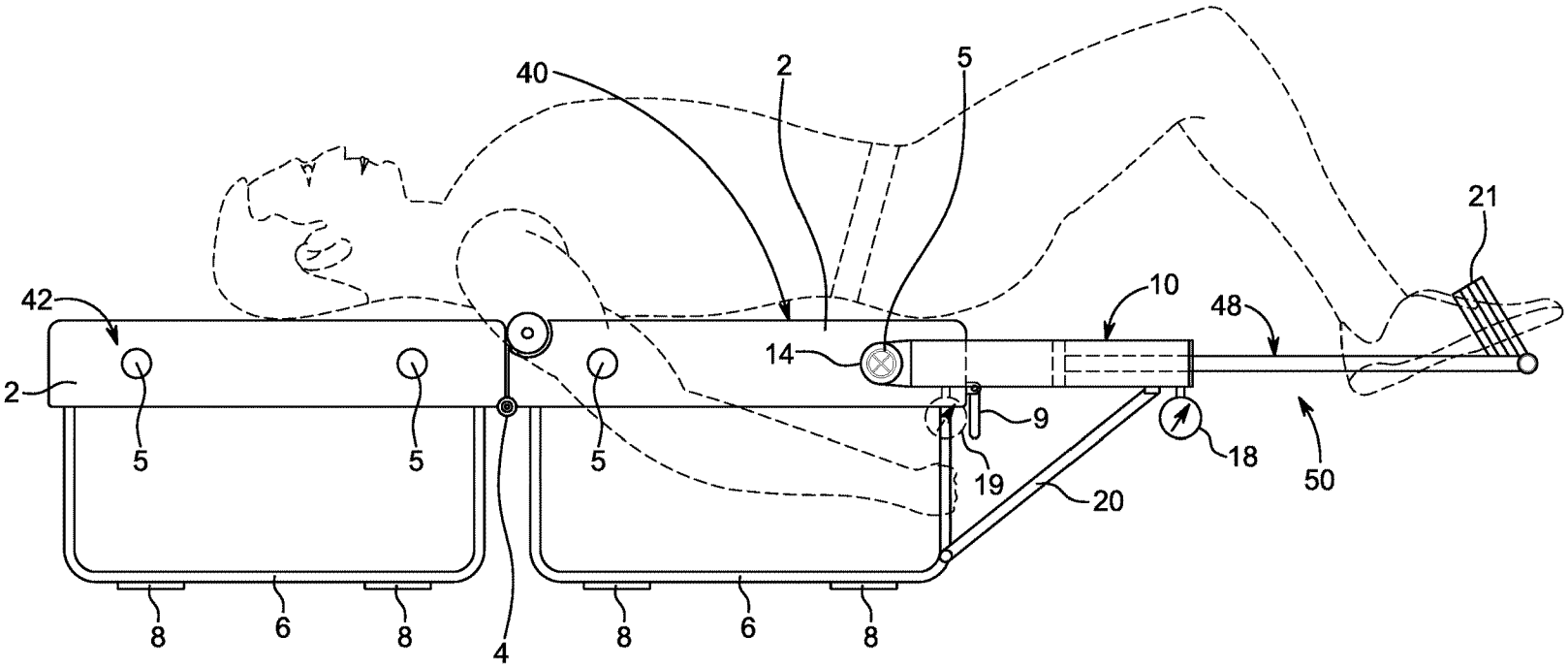
FIG. 5 is a side view of the exercise equipment system in accordance with the invention when in a use state including foot-actuated exercise baskets.

Referring now to FIG. 5, FIG. 5 shows a particular state of the exercise equipment 36 in the use state wherein a leg exercising attachment 50 is coupled to the bench 2. The leg exercising attachment 50 comprises a connection pin 14 passing through one set of aligning connection holes 5 on case half 42, and two pneumatic cylinders 10 each coupled to a respective end region of the connection pin 14. For example, connection pin 14 may extend through supports that support the pneumatic cylinders 10. The supports of the pneumatic cylinders 10 can be secured to the connection pin 14 by, for example, clamps (not shown), thereby securing the pneumatic cylinders 10 to the connection pin 14 and through the connection pin 14 to the case half 42. Connection pin 14 thus connects an end region of the support of the pneumatic cylinders 10 to the side panels of the case half 42.

The leg exercising attachment 50 also comprises two baskets 21, each connected to the actuating rod 48 extending from a respective pneumatic cylinder 10, and an adjustable force gauge 18 associated with an upper region of each pneumatic cylinder 10. Each basket 21 is configured to interact with the foot of the user, e.g., receive the foot of the user as shown. The gauges 18 function to control the resistance of movement of the actuating rod 48 from the pneumatic cylinders 10. By adjusting the gauges 18, it becomes easier or more difficult to extend the actuating rods 48 from the pneumatic cylinders 10 thereby providing an adjustable exercising force.

The leg exercising attachment 50 also comprises support bars 20 that each support a respective pneumatic cylinder 10. The support bars 20 are elongate and made of a preferably rigid material such as metal. One end region of the support bar 20 is attached to a respective leg, i.e., a transverse leg 7 or one of the longitudinal legs 6, and the other end region is attached to a support of the pneumatic cylinder 10. The attachment may be by means of the formation of holes in the legs 6, 7 and the support of the pneumatic cylinder 10 and hooks at the end regions of the support bar 20 configured to pass into and be retained by the holes. Other attachment structure may be used in accordance with the invention, with the objective of the pneumatic cylinders 10 being retained in a stable position extending outward with limited or no movement during exercising.

The components of the leg exercising attachment 50 are housed in the interior compartment defined by the case 1 when in the closed state shown in FIG. 1A.

FIG. 5 also shows an outline of a person exercising using the leg exercising attachment 50. The person lies on the broad surfaces of the case halves 40, 42. The person positions their head at the front end of the case 1, and then positions their feet in the baskets 21. They can adjust the gauges 18 to control the desired tension and then exercise their legs by doing leg extensions.

Optionally, an adjustable force gauge 19 is associated with a lower region of each pneumatic cylinder 10. The gauges 19 function to control the pressure in the pneumatic cylinder 10 below the actuating rod 48 and thus resistance to movement of the actuating rod 48 into the pneumatic cylinder 10. By adjusting the gauges 19, it becomes easier or more difficult to retract the actuating rods 48 into the pneumatic cylinders 10 thereby providing an adjustable exercising force.

Gauges 18 and 19 can be used independently or together. Gauges 18 function to control the force needed to effect the extension stroke of the baskets 21 outward away from the bench 2 while gauges 19 function to control the force needed to effect the retraction stroke of the baskets 21 toward the bench 2. It is of course possible for the user to independently adjust the gauges 18, 19 for the left and right pneumatic cylinders 10 so they can provide varied resistances for their right and left leg extensions.

In use, the user passes the connection pin 14 through the aligning holes 5, removing the covers of the holes 5 if present. The user then attaches the pneumatic cylinders 10 to the connection pin 14 and fixes then thereto, e.g., using clamps. The support bars 20 are then attached to retain the pneumatic cylinders 10 in a stable position. The baskets 21 are attached to the actuating rods 49. The leg exercise equipment 50 is then ready for use.

The user lies on the broad surfaces of the case halves 40, 42 defining the bench 2 and inserts their feet into the baskets 21. The user adjusts the gauges 18, 19 on both the left and right sides to the desired pressure. The user then can exercise their legs pushing them outward and retracting them. The user can grasp the legs 6,7 at the rear of the bench 2 if so desired.

Figure 6A:
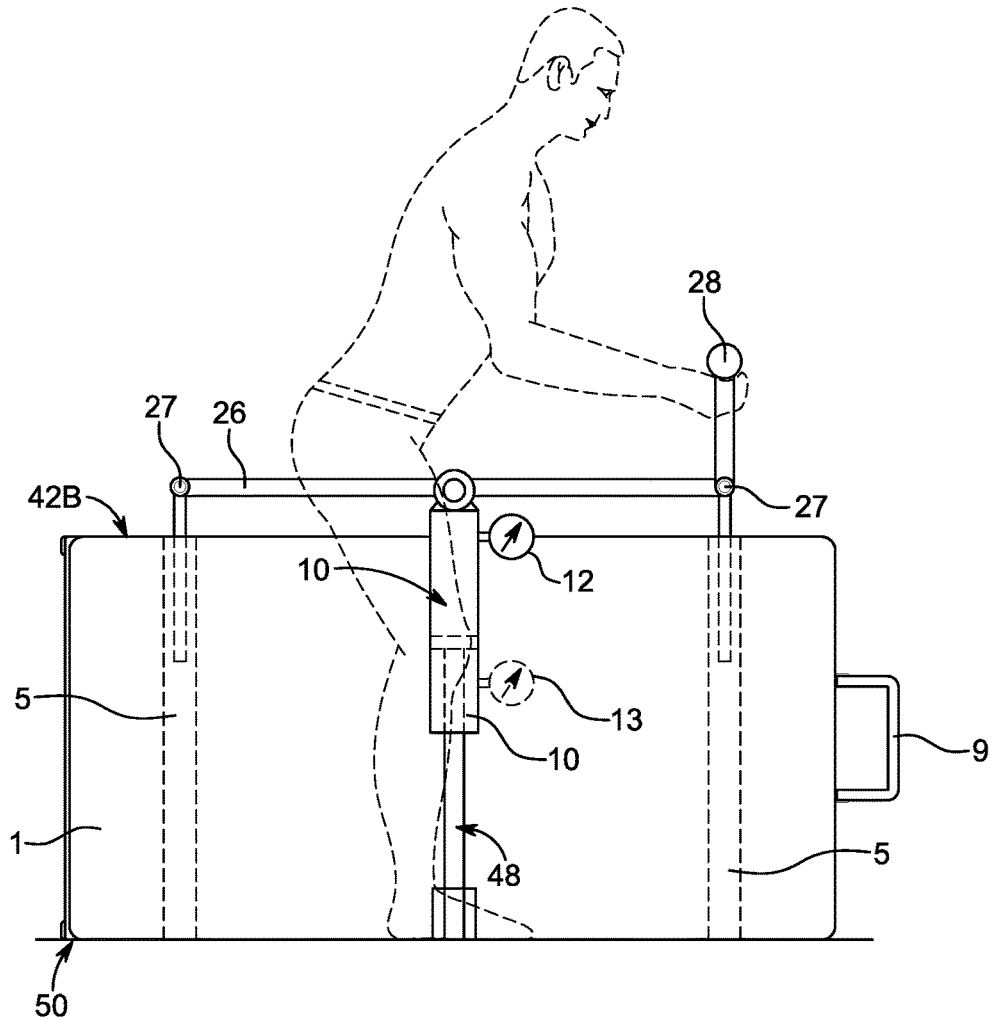
FIG. 6A is a side view of the exercise equipment system in accordance with the invention when in a use state including an arm exercise equipment.
Figure 6B:
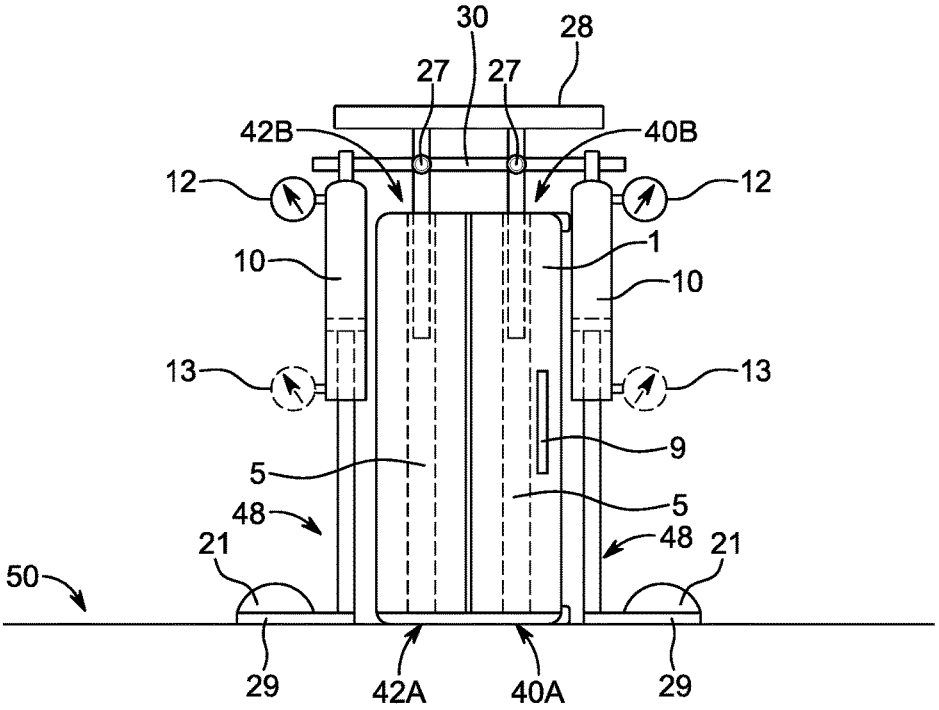
FIG. 6B is a front view of the exercise equipment system when in the configuration shown in FIG. 6A.

FIGS. 6A and 6B show another manner in which the exercise equipment 36 can be used. In this manner of use, the case 1 is closed and the case halves 40, 42 are positioned with a side 40A, 42A against a flat support surface 52. A connection pin 27 is coupled to each exposed connection hole 5 in side 40B, 42B and optionally retained therein, e.g., by a clamp (not shown). A longitudinally extending connection bar 26 is connected to the exposed end regions of aligning connection pins 27 (see FIG. 6A).

A cylinder support bar 30 is connected to the connection bars 26, e.g., perpendicular thereto, and extends beyond the lateral edges of the case 1 (see FIG. 6B). This connection may be by passing the cylinder support bar 30 through apertures in the connection bars 26. A pneumatic cylinder 10 is attached to each end region of the cylinder support bar 30 and secured thereto, e.g., by a clamp (not shown), see FIG. 6B. Gauges 12, 13 are optionally coupled to each pneumatic cylinder 10 (see the description above for the use of these gauges).

The arm exercise system 54 includes, in addition to the pneumatic cylinders 10, gauges 12, 13, cylinder connection bars 26, and cylinder connection pins 27, plates 29 each connected to a lower end of a respective pneumatic cylinder 10. A basket 21 is attached to each plate 29. The plates 29 are configured to rest in the support surface 52. A handle bar 28 is attached to one set of the cylinder connection pins 27.

To assemble arm exercise system 54, the user positions case halves 40, 42 against the support surface 52, inserts a connection pin 27 into each exposed connection hole 5 in sides 40B, 42B, and connects connection bar 26 to the exposed end regions of aligning connection pins 27. The user connects cylinder support bar 30 to the connection bars 26 and attaches a pneumatic cylinder 10 to each end region of the cylinder support bar 30. The user also couples the plates 29 to the supports of the pneumatic cylinders 10 and attaches the baskets 21 to the plates 29.

For use, the user sits on the case 1 and places their feet into the baskets 21. The user grasps the handle bar 28 and after adjusting independently gauges 12, 13, is ready to perform leg exercises by moving their feet up and down while retained in the baskets 21.

Figure 7:
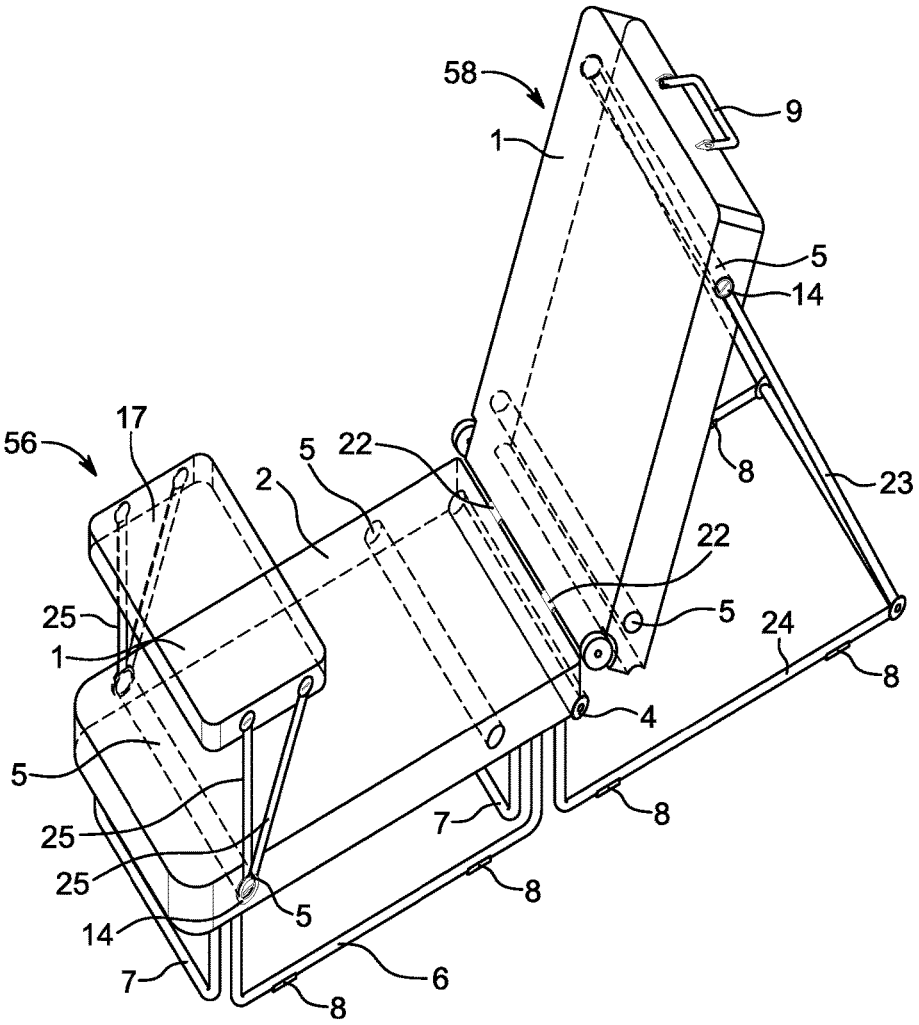
FIG. 7 is a perspective view of an exercise equipment system in accordance with the invention when in a use state.

FIG. 7 shows another manner for using exercise equipment. In this embodiment, the exercise equipment 36 includes a table assembly 56 that is attached to case half 40 by a connection pin 14 extending through aligning connection holes 5. The table assembly 56 includes, on each side, two support bars 25 that are connected to the connection pin 14 at one end region. An opposite end region of the support bars 25 is connected to the table 17. Support bars 25 are configured to allow the table 17 to be fixed in a stable position, e.g., by allowing tightening of the connections between the table 17 and the connection pin 14.

FIG. 7 also shows an angled backrest 58 formed by angling the case half 42 using connection hooks 22. Connection hooks 22 connect the case halves 40, 42 in a manner allowing for the formation of the angle between the broad surface of case half 40 and the broad surface of case half 42. A bench rest support bar 23 and a back rest leg 24 are provided to maintain the case half 42 in the angled position.

Bench rest support bar 23 is attached to the case half 42 by a connection pin 14 extending through a set of aligning connection holes 5. Back rest leg 24 may be connected to the bench rest support bar 23 and to one or both of the case halves 40, 42.

When in the configuration shown in FIG. 7, the exercise equipment 38 can be used to lift free weights, or in any ways readily identifiable to those skilled in the art of weight lifting and exercising. Indeed, the exemplifying configurations of the exercising equipment 36 is not meant to limit the use of the components of the exercise equipment and any other conceivable sues and configurations of the components are encompassed within the scope and spirit of the invention.

Generally, the presence of aligning connection holes 5 on opposite sides one or both case halves 40, 42 allows for the connection of the connection pins 14 and in turn, attachment of pneumatic cylinders 10 or other disclosed components to the connection pin 14. This provides a secure attachment of exercise equipment to the case 1. Thus, the presence of the aligning connection holes 5 is an important aspect of the invention, enabling passage therethrough of the connection pin 14

Figure 8:
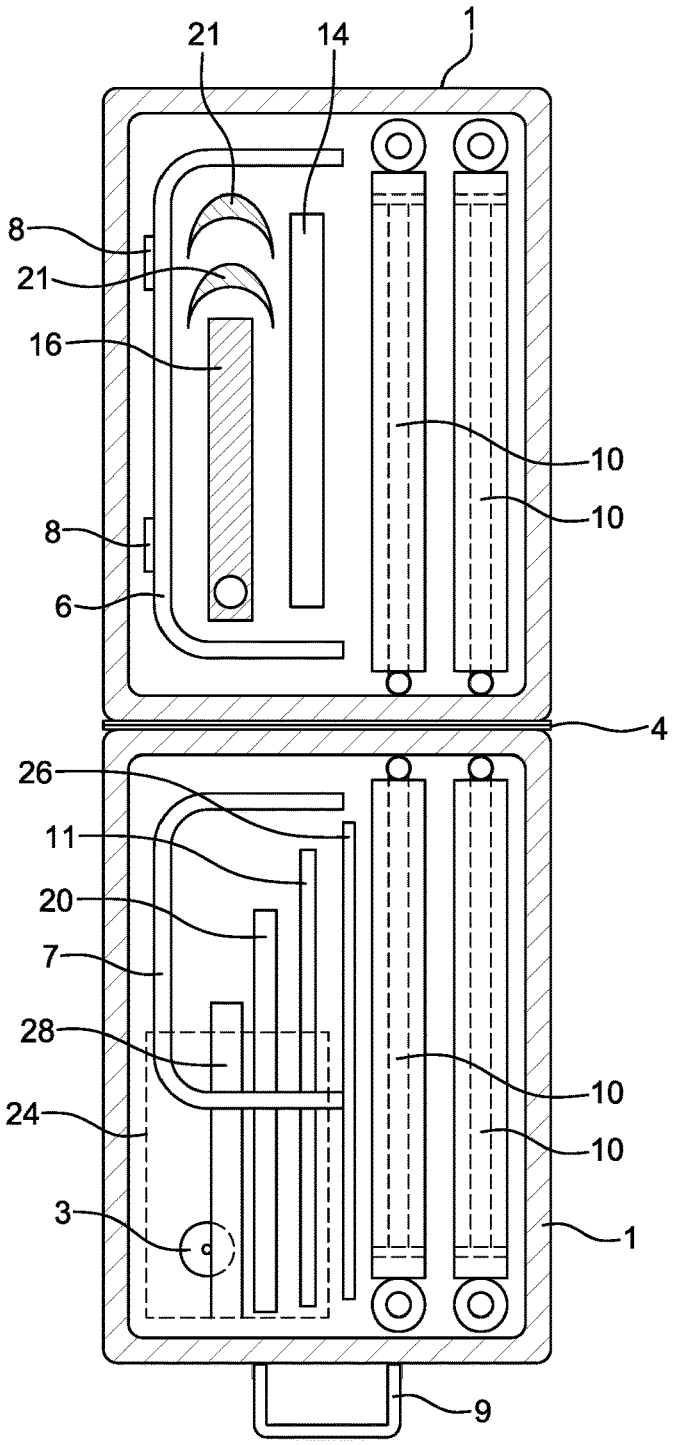
FIG. 8 is a view showing the components of the exercise equipment system in accordance with the invention inside the interior compartment defined by the case.

FIG. 8 shows one manner in which the components of the exercise equipment 36 described above are housed in the interior compartment of the case 1. The inner surfaces of the case halves 40, 42 are provided with retaining structure, e.g., foam. Case half 40 is shown including two pneumatic cylinders 10 with the actuating rods situated therein, bar 11, support bar 20, cylinder connection bar 26, handle bar 28, removable wheels 3 and back rest leg 24. Case half 42 is shown including two pneumatic cylinders 10 with the actuating rods 48 situated therein, a connection pin 14, belt lock pin 16 with the belt 15, baskets 21, and legs 6, only one of which is shown. The presence of the particular components in each of case halves 40, 42 is for illustration purposes only and different components may be housed in each case halves 40, 42 and all of the components are not shown.

Figure 9:
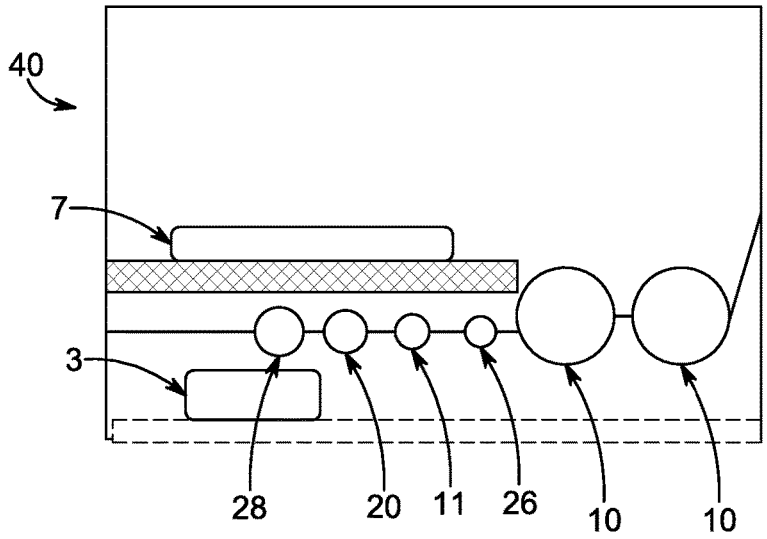
FIG. 9 is a cross-sectional view of the lowermost case half shown in FIG. 8.

The components may be arranged in levels in the interior space defined by each of the case halves 40, 42. FIG. 9 shows a cross-section of case 40 showing different levels of the components.

Figure 10:
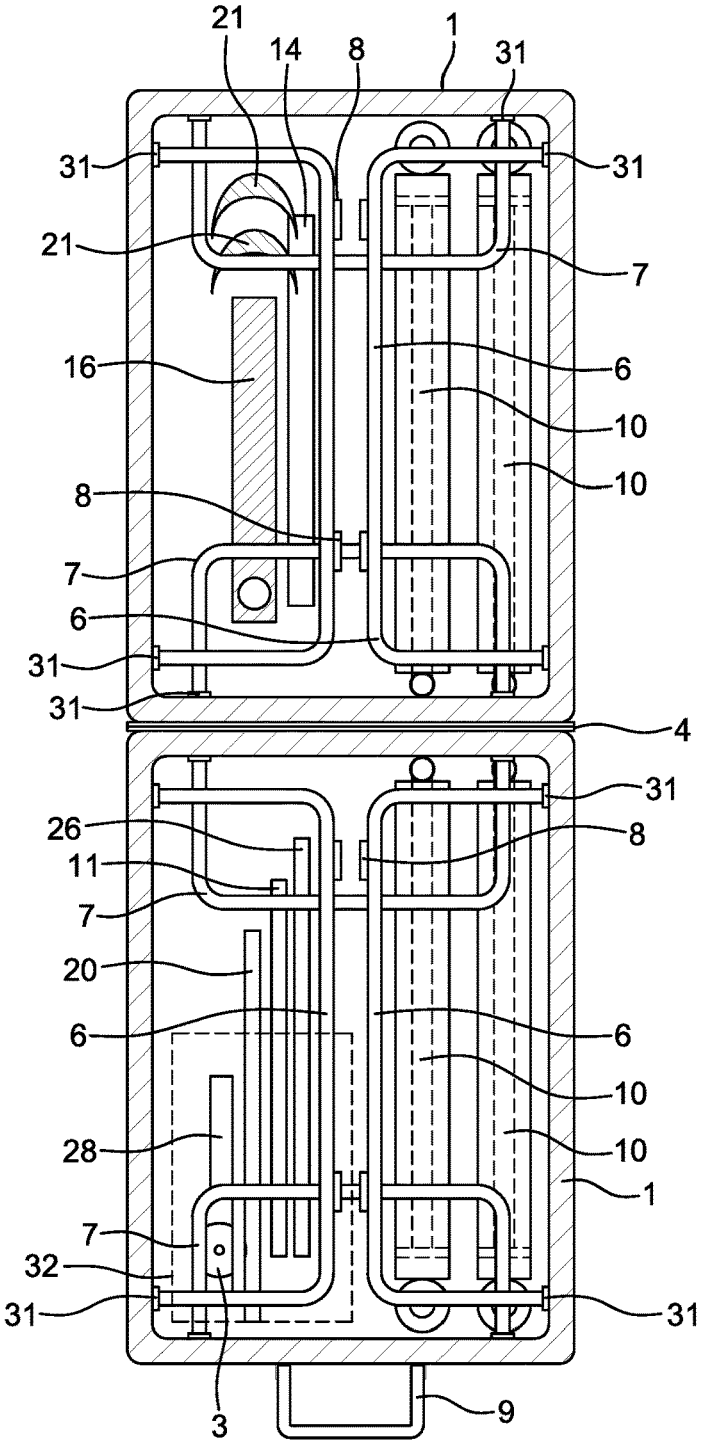
FIG. 10 is another view showing the components of the exercise equipment system in accordance with the invention inside the interior compartment defined by the case.

FIG. 10 shows one manner in which the components of the exercise equipment 36 described above are housed in the interior compartment of the case 1. The main difference between this configuration and that shown in FIG. 8 is that in this embodiment, the legs 6, 7 are foldable. Thus, they are attached at the ends to the side panels of the case halves 40, 42 and can be folded outward, and then optionally locked in position. A joint 31 is provided interposed between each leg end and the side panels and allows for this folding movement.

The components may be arranged in levels in the interior space defined by each of the case halves 40, 42, and foam 32 provided to spaced the components and cushion them as well. Instead of foam, other support structure and cushioning structure may be provided, with a single component that provided both functions or separate components that can be used independently from one another or together.

Figure 11:
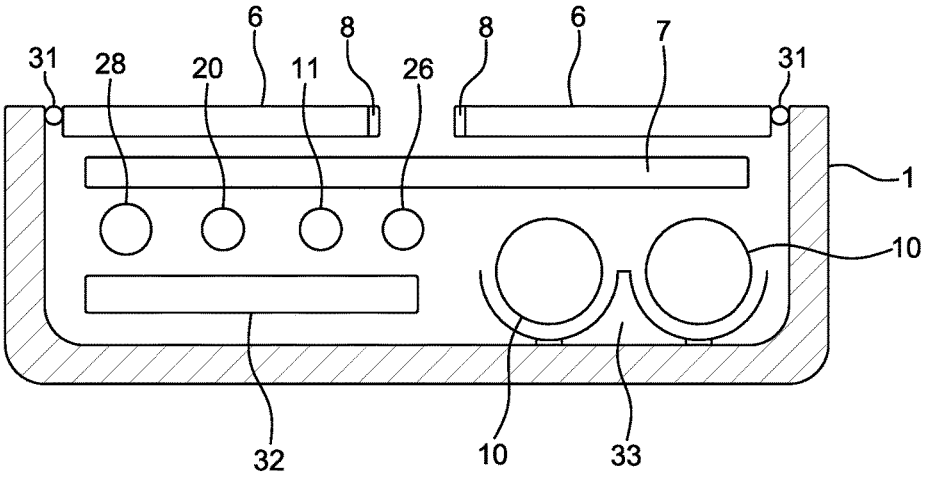
FIG. 11 is a cross-sectional view of the lowermost case half shown in FIG. 10.

FIG. 11 shows a cross-section of case 40 showing different levels of the components, and the positioning of the legs 6 at the upper edge region of the side panels (when the case half 40 is in the configuration shown in FIG. 11). This positioning at the upper edge region facilitates the outward folding of the legs 6 (as well as legs 7) from the case half 40. The joints 7 for legs 7 may be situated below the joints for legs 6 so that legs 6 are folded on top of legs 7, i.e., when disassembling the exercise equipment, legs 7 are folded first and then legs 6 folded. As such, remaining components of the exercise equipment 36 are housed in the case halves 40, 42 below the foldable legs 6, 7.

A support structure 33 is also shown to support the pneumatic cylinders 10.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention. For example, mention is often made to use of comparable or equivalent components for disclosed structure. Such comparable or equivalent components may be found in, for example, prior art identified in the specification.

Finally, all of the disclosed components herein can be used in any of the disclosed embodiments herein and there is no limitations implied in this specification to having any disclosed component present only when disclosed and illustrated. Any disclosed and illustrated component can be used not only in its disclosed embodiment, but also in any other disclosed and/or illustrated embodiment.

What is claimed is:

1. Exercise equipment, comprising:

a case having first and second parts, said first part being movable relative to said second part and defining a closed state in which an interior compartment is defined in said case and an open state in which said interior compartment is accessible, each of said first and second parts having a bottom panel and at least one side panel extending from an outer edge of said bottom panel, said at least one side panel of said first part providing two opposite panel portions, said first part including a pair of connection implements in or on said two opposite panel portions of said at least one side panel opposite one another;

a connection pin that fits in said interior compartment, said connection pin being configured to engage with both connection implements of said pair of connection implements;

a first pneumatic cylinder that fits in said interior compartment, said first pneumatic cylinder being connectable to said connection pin and including an actuating rod that is extendable from said first pneumatic cylinder; and an attachment that fits in said interior compartment and attachable to said actuating rod and configured to allow a user to interact therewith to exercise.

2. The exercise equipment of claim 1, wherein said bottom panel of said first part is rectangular having four sides and said at least one side panel of said first part comprises four side panels each extending from an outer edge of a respective one of said four sides of said bottom panel of said first part.

3. The exercise equipment of claim 2, wherein said pair of connection implements are in or on opposite ones of said four side panels of said first part such that said opposite ones of said four side panels provide said two opposite panel portions of said at least one panel of said first part.

4. The exercise equipment of claim 3, wherein said first part includes an additional pair of connection implements in said opposite ones of said four side panels of said first part.

5. The exercise equipment of claim 1, wherein said pair of connection implements comprise connection holes in said two opposite panel portions of said at least one side panel of said first part, said connection pin being configured to extend into and through said connection holes with a respective portion extending beyond both of said connection holes.

6. The exercise equipment of claim 5, further comprising:

a belt lock pin that fits in said interior compartment, said belt lock pin being configured to extend through said connection holes of said pair of connection implements with a respective portion extending beyond both of said connection holes of said pair of connection implements; and a belt that fits in said interior compartment and which is connected to said belt lock pin.

7. The exercise equipment of claim 1, further comprising a first tension control device that fits in said interior compartment and connectable to said first pneumatic cylinder to control resistance of outward movement of said actuating rod from said first pneumatic cylinder.

8. The exercise equipment of claim 7, further comprising a second tension control device that fits in said interior compartment and connectable to said first pneumatic cylinder to control resistance of inward movement of said actuating rod into said first pneumatic cylinder.

9. The exercise equipment of claim 1, wherein said at least one side panel of said second part provides two opposite panel portions, said first part includes an additional pair of connection implements in or on said two opposite panel portions of said at least one side panel opposite one another and said second part includes two pair of connection implements in or on said two opposite panel portions of said at least one side panel opposite one another, said additional pair of connection implements of said first part and said two pair of connection implements of said second part being additional connection implements, further comprising:

a second pneumatic cylinder that fits in said interior compartment, said second pneumatic cylinder including an actuating rod that is extendable from said second pneumatic cylinder;

additional connection pins that fit in said interior compartment and each engaging with a respective one of said additional connection implements in an exposed panel portion of said first or second part of said case when an opposite panel portion of said first or second part of said case is against a support surface;

two longitudinally extending connection bars that fit in said interior compartment and connectable to exposed end regions of an aligning pair of said additional connection pins; and a cylinder support bar that fits in said interior compartment and connectable to said two longitudinally extending connection bars and extending beyond lateral edges of said case, said first and second pneumatic cylinders being attachable to end regions of said cylinder support bar, said attachment including plates connected to lower ends of said first and second pneumatic cylinders and a basket attachable to each of said plates, said plates and said baskets fitting in said interior compartment, said plates being configured to rest on the support surface.

10. The exercise equipment of claim 9, further comprising a handle bar that fits in said interior compartment and attachable to one set of said additional connection pins.

11. The exercise equipment of claim 1, further comprising support legs that fit in said interior compartment and pivotally connected to each of said first and second parts, said support legs being foldable outward from said interior compartment to form a support structure for said first and second parts.

12. The exercise equipment of claim 11, further comprising joints for pivotally connecting ends of each of said support legs to said at least one side panel of each of said first and second parts.

13. The exercise equipment of claim 1, further comprising support legs that fit in said interior compartment, said support legs having an extended position in which said support legs support said first and second parts above a support surface.

14. The exercise equipment of claim 1, further comprising a handle attached to an exterior of said first part and at least one wheel attached to said first or second part at an opposite end of said case from said handle.

15. The exercise equipment of claim 1, further comprising:

a second pneumatic cylinder that fits in said interior compartment, said second pneumatic cylinder being connectable to said connection pin on an opposite side of said first part from a side on which said first pneumatic cylinder is connectable to said connection pin, said second pneumatic cylinder including an actuating rod that is extendable from said second pneumatic cylinder, said attachment comprising an elongate bar attachable to said actuating rods of both of said first and second pneumatic cylinders.

16. The exercise equipment of claim 1, further comprising a tension control device that fits in said interior compartment and connectable to said first pneumatic cylinder to control resistance of inward movement of said actuating rod into said first pneumatic cylinder.

17. The exercise equipment of claim 1, further comprising:

a belt lock pin that fits in said interior compartment, said belt lock pin being configured to engage with said pair of connection implements; and a belt that fits in said interior compartment and which is connected to said belt lock pin.

18. The exercise equipment of claim 1, further comprising:

a second pneumatic cylinder that fits in said interior compartment, said second pneumatic cylinder being connectable to said connection pin on an opposite side of said first part from a side on which said first pneumatic cylinder is connectable to said connection pin, said second pneumatic cylinder including an actuating rod that is extendable from said second pneumatic cylinder, said attachment comprising two baskets each attachable to a respective one of said actuating rods of said first and second pneumatic cylinders, and support bars that each support a respective one of said first and second pneumatic cylinders when extending longitudinally outward from a longitudinal end of said first part.

19. The exercise equipment of claim 1, wherein said attachment comprises a table attachable to said first part, said table includes, on each of two opposite side, two support bars that are connected to said connection pin at one end region, an opposite end region of said support bars being connected to said table.

20. The exercise equipment of claim 1, wherein said second part is attached to said first part at an angle between 90 degrees and 180 degrees.

* * * * *